US006321575B1

(12) United States Patent
Sangiacomo

(10) Patent No.: US 6,321,575 B1
(45) Date of Patent: Nov. 27, 2001

(54) SYSTEM OF CAMS AND SINKER FOR TERRY CLOTH KNITTING ON CIRCULAR KNITTING MACHINES AND STOCKING KNITTING MACHINES

(75) Inventor: Fulvio Sangiacomo, Brescia (IT)

(73) Assignee: Sangiacomo S.p.A. (IT)

( * ) Notice: Subject to any disclaimer, the term of this patent is extended or adjusted under 35 U.S.C. 154(b) by 0 days.

(21) Appl. No.: 09/790,084

(22) Filed: Feb. 21, 2001

(30) Foreign Application Priority Data

May 10, 2000 (IT) ..... BS2000A45

(51) Int. Cl.[7] ..... D04B 15/06
(52) U.S. Cl. ..... 66/93; 66/108 R; 66/107
(58) Field of Search ..... 66/19, 31, 20, 66/23, 25, 27, 91, 97, 93, 107, 104, 217, 108 R

(56) References Cited

U.S. PATENT DOCUMENTS 3,221,521 * 12/1965 Mishcon ..... 66/93
4,519,221 * 5/1985 Hirano ..... 66/107
4,955,211 * 9/1990 Neher ..... 66/9 R
4,986,090 * 1/1991 Lombardi ..... 66/93
4,989,421 * 2/1991 Schmidt ..... 66/9 R
5,477,707 * 12/1995 Renda et al. ..... 66/93
5,511,393 * 4/1996 Hu ..... 66/93
6,089,047 * 7/2000 Wang ..... 66/91

* cited by examiner

*Primary Examiner*—Danny Worrell
(74) *Attorney, Agent, or Firm*—McGlew and Tuttle, P.C.

(57) ABSTRACT

A system of cams and a sinker for terry cloth knitting using the needles on circular knitting machines and stocking knitting machines. Cam means (20, 21, 22) are provided for selectively interacting with a control bottom part (18) and with a shoulder (19) for the inlet and outlet differential longitudinal movements of each sinker in relation to the needles for a selective plain stitch formation at a horizontal plane (14), a terry cloth stitch at a top mouth (15) and a mixed stitch at an intermediate notch (17) on the head of the sinker proper.

7 Claims, 2 Drawing Sheets

SYSTEM OF CAMS AND SINKER FOR TERRY CLOTH KNITTING ON CIRCULAR KNITTING MACHINES AND STOCKING KNITTING MACHINES

FIELD OF THE INVENTION

The present invention pertains to circular knitting machines and stocking knitting machines for terry cloth knitting, and it pertains specifically to a system of cams and a sinker for terry cloth knitting on such machines.

BACKGROUND OF THE INVENTION

One of the methods for terry cloth knitting on circular knitting machines and stocking knitting machines provides for the use, in combination, of vertical needles on the cylinder and terry cloth sinkers arranged horizontally on a ring of sinkers that lies above the cylinder and rotates with same. The terry cloth stitch is usually produced by at least two yarns fed in such a way that a first yarn contributes to the formation of a basic stitch, while the other yarn is used to form oblong terry cloth loops on the terry cloth sinkers.

To this end, each sinker usually has a plane for the formation of the basic stitch and at least one mouth, which lies above this plane and is intended to receive the yarn for the formation of terry cloth loops or curls.

The operating movements of the sinkers in relation to the needles for the collection of yarns on the stitch formation plane and on the mouth for formation of terry cloth loops are controlled by inlet and outlet cams with their own prearranged profile. However, the cams, on the one hand, and the sinkers, on the other hand, as they are currently configured, do not make it possible to use these sinkers for plain and terry cloth knitting or the production of manufactured articles that have plain stitch parts and terry cloth stitch parts. To carry out this type of knitting using the cams available, it is necessary to remove the upper mouth of the sinkers that must produce only the plain stitch or simply to replace the terry sloth sinkers with plain stitch sinkers corresponding to the non-terry cloth parts within the framework of a manufactured article.

SUMMARY AND OBJECTS OF THE INVENTION

One object of the present invention is to create the conditions for always advantageously being able to use the same sinkers in association with the needles on the cylinder for the production either of a terry cloth stitch or of a plain stitch, therefore without having to substitute the sinkers or to change their structure by means of removing the mouth for the terry cloth.

Another object of the present invention is to provide a sinker that can be selectively used for the production both of a terry cloth stitch and of a plain stitch or terry cloth means according to the knitting requirements of a manufactured article.

A further object of the present invention is to provide improved cam means for a selective control of the sinkers that must produce a terry cloth stitch by the said sinkers that must knit a plain stitch, the cam means including movable parts that can be moved between an inactive position and an active position.

According to the invention, a system of cams and a sinker for terry cloth knitting with needles on circular knitting machines and stocking knitting machines is provided. The sinker has a shaft with a control bottom part and a head having a horizontal plain stitch formation plane, a top mouth for the formation of terry cloth loops, an intermediate mouth delimiting with the top mouth a notch for the formation of a mixed plain stitch, and a rear shoulder which is turned towards the bottom part and is perpendicular to the shaft. The cam device is intended to selectively interact with the control bottom part and with the shoulder for differentiated inlet and outlet longitudinal movements of each sinker in relation to the needles for a selective formation of a plain stitch at the said horizontal plane, a terry cloth stitch at the top mouth and a mixed stitch at the notch of the sinker itself.

The cams may comprise a fixed cam track which is provided for acting against the shoulder for an inlet of the sinker for the formation of a plain stitch on the horizontal plane, at least a first movable lever arranged on the outside of the said fixed cam track and movable between an inactive position and an active position for acting against the control bottom part for an inlet of the sinker for the formation of a terry cloth stitch on the said top mouth, and at least a second movable lever, which can be moved between an inactive position and an active position for acting against the said shoulder or against the control bottom part of the sinker for an inlet of same for the formation of a mixed plain stitch in the intermediate notch. Such a second movable lever or the second movable levers can be moved between the inactive and active positions by a rotating cam ring.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
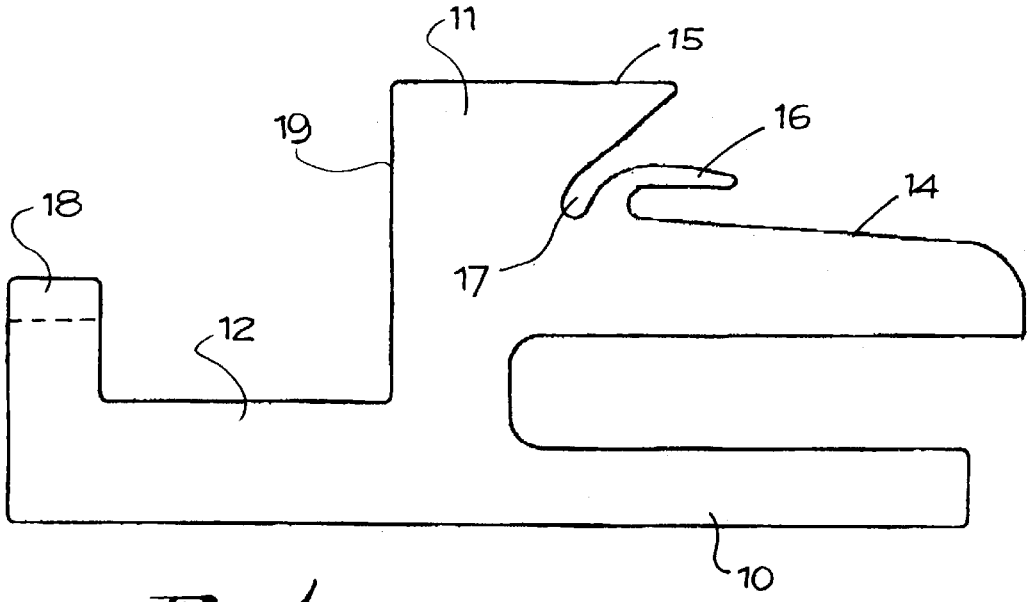
FIG. 1 is a side view of a sinker for a terry cloth stitch.
Figure 2:
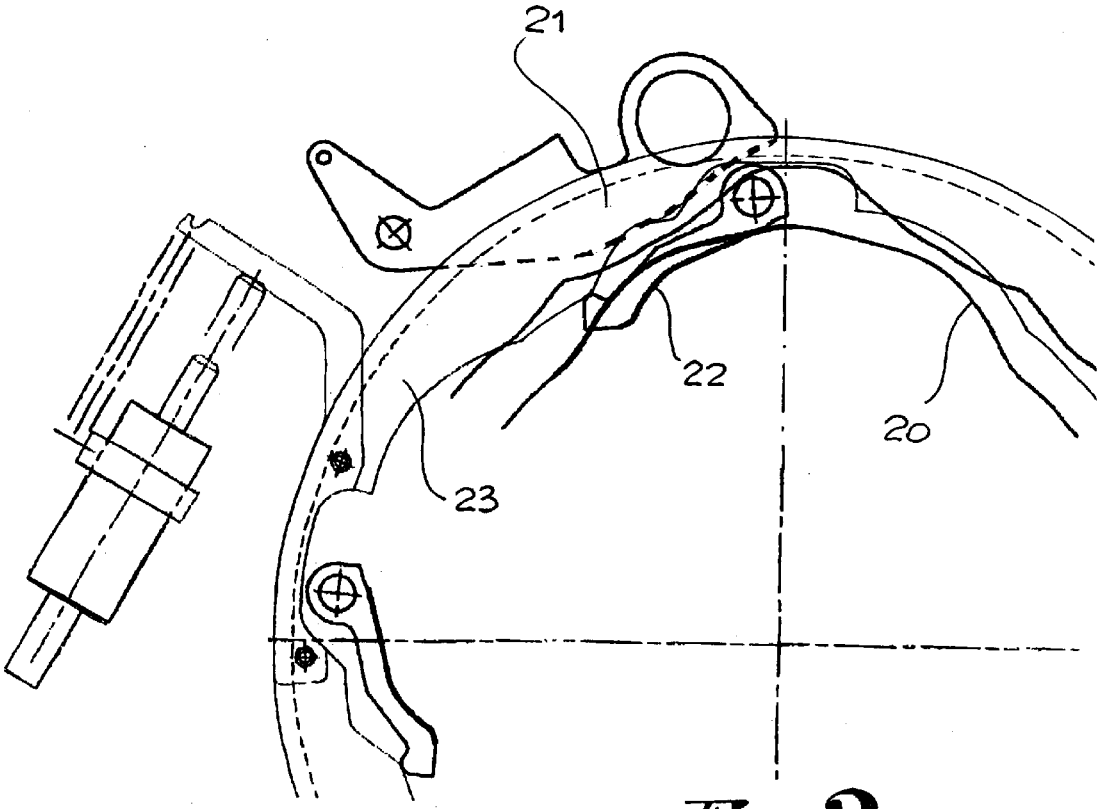
FIG. 2 is a top view of the system of cams of the present invention.

Referring to the drawings in particular, FIG. 1 shows a sinker 10 with a related head 11 and a shaft 12 in association with a needle 13 for knitting on circular knitting machines and on stocking knitting machines. The head 11 of the sinker rises above the shaft and has a horizontal plain stitch formation plane 14, atop mouth 15 for the formation of terry cloth loops, between the said plane 14 and said top mouth 15 an intermediate mouth 16, delimiting with the upper mouth 15, a plain stitch or mixed stitch notch 17 contrary to that obtained on the plane 14. A shaft 12 is provided with a control bottom part 18 intended to interact with cam pushing means for the longitudinal operating movements of the sinker 10 in relation to the needles 13. Also, the rear side of the head, turned towards the bottom part and perpendicular to the shaft, forms a shoulder 19 that is intended to be engaged by at least one means for the longitudinal movement of the sinker.

The means for controlling the sinkers 10 comprise a fixed cam track 20, at least a first movable pushing lever 21, which is arranged on the outside of the cam track 20 and can be moved between an inactive position and an active position with a respective control member (not shown), and at least a second movable lever 22, which is arranged on the inside of the cam track 20 and can also be moved between an inactive position and an active position, e.g., through a rotating cam ring 23, which can control several homologous levers 22 at the same time.

Figure 3:
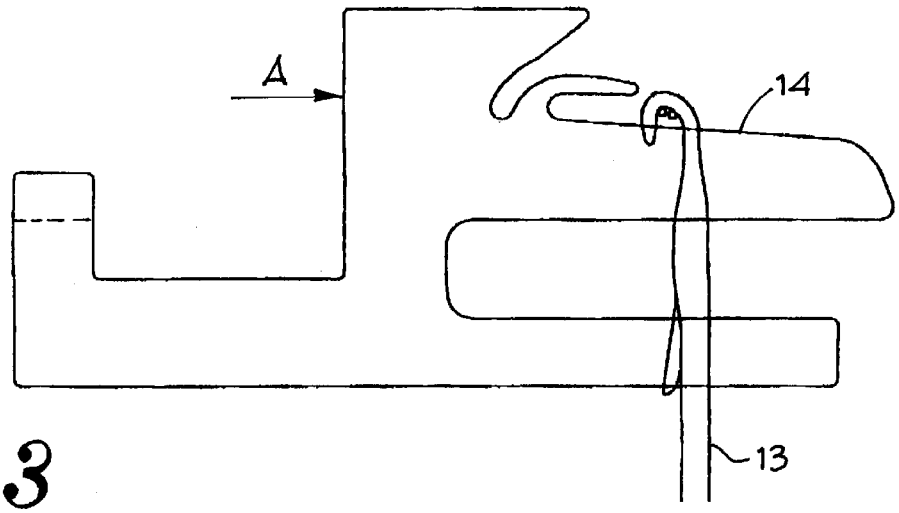
FIG. 3 is a view showing a knitting condition of a sinker with a needle depending on the control of the sinker by the cams of FIG. 2.

The cam track 20 is provided for acting against the shoulder 19 of the head 11 of the sinkers and to move same in relation to the needles 13 according to arrow A of FIG. 3 so as to form, with the yams fed in, a plain stitch on the horizontal plane 14 of the sinkers.

Figure 4:
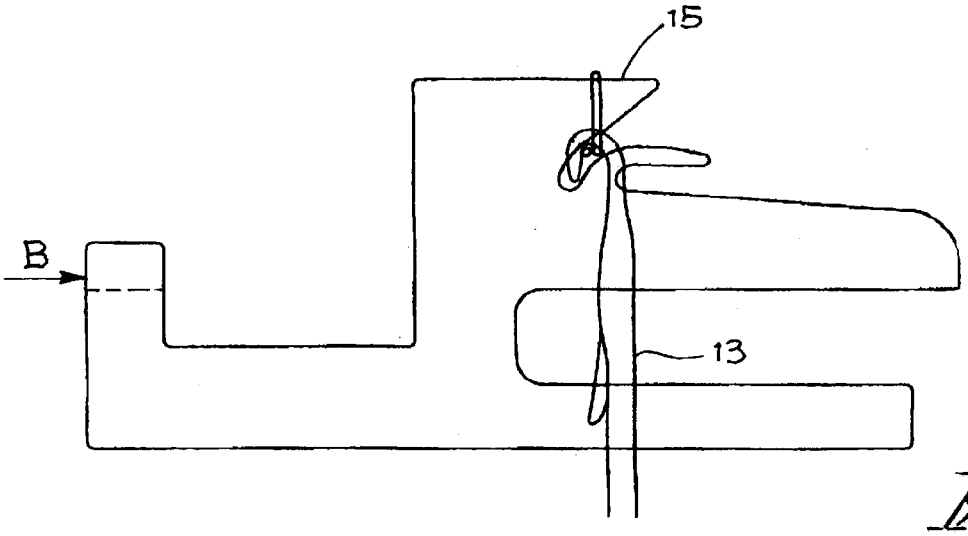
FIG. 4 is a view showing another knitting condition of a sinker with a needle depending on the control of the sinker by the cams of FIG. 2.

The first lever 21 is provided for acting, when it is in the active position, against the bottom part 18 of the sinkers for moving same radially in relation to the needles according to arrow B of FIG. 4 so as to form a terry cloth stitch with one of the yams fed in, which is collected from the top mouth of the sinker, forming terry cloth loops or curls.

Figure 5:
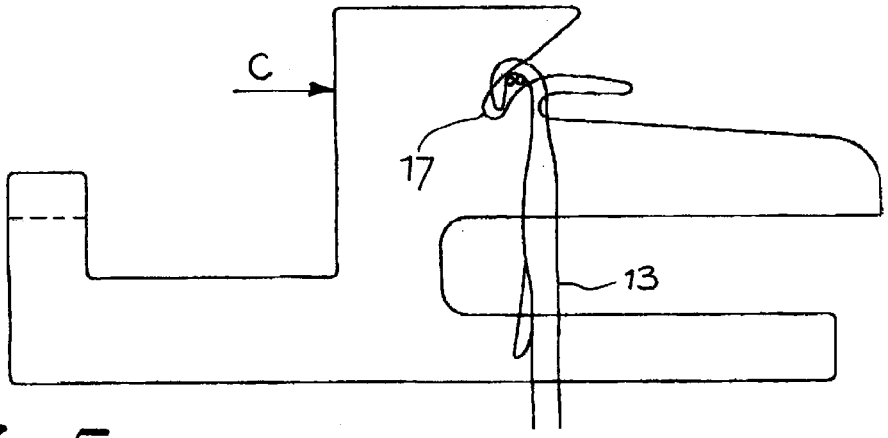
FIG. 5 is a view showing another knitting condition of a sinker with a needle depending on the control of the sinker by the cams of FIG. 2.

The second lever 22, when it is in the active position, defines a different course from that of the cam track 20, and acts on the shoulder 19 of the head of the sinkers according to the arrow C of FIG. 5, moving the sinkers radially in relation to the needles to form a stitch with the yarns fed in at the notch 17 between the upper mouth 15 and the intermediate mouth 16 of the sinkers.

The second movable lever 22, rather than being inside the fixed cam track and provided for acting on the shoulder 19 of the head of the sinkers, may be connected on the side of the first lever 21 and act against the bottom part of the sinkers, but always with the same function of carrying the sinkers into the position for the stitch formation in the notch 17.

By using sinkers with bottom parts having different heights, it is also possible to select, by means of the first movable lever, the sinkers that must always produce a terry cloth stitch from other sinkers that must produce a plain stitch.

In each case, the different types of stitch can be produced only by means of a differentiated and selective control of the sinkers by means of the fixed cams 20 or of the movable levers 21, 22, without every having to replace or change the head of the sinkers proper.

While specific embodiments of the invention have been shown and described in detail to illustrate the application of the principles of the invention, it will be understood that the invention may be embodied otherwise without departing from such principles.

What is claimed is:

1. A cam and sinker system with needles for terry cloth formation on circular knitting machines and stocking knitting machines, the system comprising:

sinkers, each sinker including a shaft and a control bottom part, a head having a horizontal plain stitch formation plane, a top mouth for the formation of terry cloth loops, an intermediate mouth delimiting said top mouth, a notch for the formation of a mixed plain stitch, and a rear shoulder which is facing said bottom part and perpendicular to said shaft;

a cam arrangement intended to selectively interact with said control bottom part and with said shoulder for differentiated inlet and outlet longitudinal movements of each sinker in relation to the needles for a selective formation of a plain stitch at said horizontal plane, a terry cloth stitch at said top mouth and a mixed stitch at said notch of the sinker.

2. A system in accordance with claim 1, wherein said cam arrangement comprises a fixed cam track for acting against said shoulder for an inlet of the sinker for the formation of a plain stitch on said horizontal plane, at least a first movable lever arranged on an outside of said fixed cam track and movable between an inactive position and an active position for acting against said control bottom part for an inlet of the sinker for the formation of a terry cloth stitch on said top mouth, and at least a second movable lever, which can be moved between an inactive position and an active position for acting against said shoulder or against said control bottom part of the sinker for an inlet of same for the formation of a mixed plain stitch in said intermediate notch.

3. A system in accordance with claim 2, further comprising: a rotating cam ring, wherein at least said second movable lever can be moved between the inactive and active positions by means of said rotating cam ring.

4. A system in accordance with claim 2, further comprising: another second movable lever; and a rotating cam ring, wherein said second movable levers can be moved between the inactive and active positions by means of said rotating cam ring.

5. A cam and sinker system with needles for terry cloth formation on circular knitting machines and stocking knitting machines, the system comprising:

a sinker including a shaft and a control bottom part, a head having a horizontal plain stitch formation plane, a top mouth for the formation of terry cloth loops, an intermediate mouth delimiting said top mouth, a notch for the formation of a mixed plain stitch, and a rear shoulder which is facing said bottom part and perpendicular to said shaft;

a cam arrangement selectively interacable with said control bottom part and with said shoulder for differentiated inlet and outlet longitudinal movements of each sinker in relation to the needles for a selective formation of a plain stitch at said horizontal plane, a terry cloth stitch at said top mouth and a mixed stitch at said notch of the sinker.

6. A cam and sinker system with needles for terry cloth formation on a knitting machine, the system comprising:

a plurality of sinkers, each said sinker including a shaft and a control part arranged at one end of said shaft, said each sinker includes a head arranged at another end of said shaft, said head having a plain stitch formation plane, a terry mouth for formation of terry cloth loops, an intermediate mouth delimiting said terry mouth, a notch for the formation of a mixed plain stitch, and a shoulder extending substantially perpendicular to said shaft, said shoulder facing said control part, said sinkers being longitudinal movable in the knitting machine for a selective formation of a plain stitch at said plain stitch formation plane, a terry cloth stitch at said top mouth and a mixed stitch at said notch of the sinker;

a cam arrangement selectively interactable with said control part and with said shoulder of said each sinker for selective longitudinal movements of said each sinker in relation to the needles.

7. A system in accordance with claim 6, wherein:

said cam arrangement is radially movable with respect to the knitting machine to be selectively interactable with said sinkers.

* * * * *